US008292733B2

(12) United States Patent
Crawford et al.

(10) Patent No.: US 8,292,733 B2
(45) Date of Patent: Oct. 23, 2012

(54) ENTERTAINMENT SYSTEM PROVIDING DYNAMICALLY AUGMENTED GAME SURFACES FOR INTERACTIVE FUN AND LEARNING

(75) Inventors: David W. Crawford, Long Beach, CA (US); Mark R. Mine, Canyon Country, CA (US); Jason M. Lambert, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 500 days.

(21) Appl. No.: 12/551,243

(22) Filed: Aug. 31, 2009

(65) Prior Publication Data

US 2011/0053688 A1 Mar. 3, 2011

(51) Int. Cl.
*A63F 9/24* (2006.01)

(52) U.S. Cl. ..... 463/31; 473/1; 473/2; 473/24; 473/27; 473/29; 273/309

(58) Field of Classification Search ..... 463/31; 473/1, 2, 4, 24, 27, 29; 273/309
See application file for complete search history.

(56) References Cited

U.S. PATENT DOCUMENTS 3,463,593 A * 8/1969 Horan ..... 473/2
3,466,038 A * 9/1969 Hill ..... 473/4
4,183,523 A * 1/1980 Hecht ..... 473/40
4,688,796 A * 8/1987 Wright ..... 473/2
4,799,687 A 1/1989 Davis et al.
4,882,676 A * 11/1989 Van De Kop et al. ..... 473/2
5,026,053 A * 6/1991 Paterson et al. ..... 473/23
5,066,008 A * 11/1991 Rivera ..... 473/23
5,342,041 A * 8/1994 Agulnek et al. ..... 473/2
5,365,427 A * 11/1994 Soignet et al. ..... 473/448
6,720,949 B1 4/2004 Pryor et al.
6,761,634 B1 * 7/2004 Peterson et al. ..... 463/30

(Continued)

FOREIGN PATENT DOCUMENTS

EP 536810 A1 * 4/1993

OTHER PUBLICATIONS

"PickPocket: A Computer Billiards Shark" written by Michael Smith, published by Science Direct, available on or before Apr. 29, 2007, Artificial Intelligence 171, pp. 1069-1091.*

(Continued)

*Primary Examiner* — William Brewster
*Assistant Examiner* — Jason Skaarup
(74) *Attorney, Agent, or Firm* — Marsh Fischmann & Breyfogle LLP; Kent A. Lembke

(57) ABSTRACT

A system is provided for visually enhancing a game structure having a game surface and objects that move on the game surface. The system includes a projector that projects digital augmentation content or themed images onto the game surface, with the images including static and animated images. The system includes a tracking mechanism that generates tracking data from the game surface and game objects, with the tracking data defining positions of the game objects relative to the game surface. The system includes a controller that processes the tracking data to determine the positions of the game objects. The controller modifies the augmentation images in response to the determined positions of the game objects. The augmentation images include a video stream made up of a base image that is mapped to the game surface and an object enhancing image mapped to one of the game objects and its current position.

18 Claims, 7 Drawing Sheets

U.S. PATENT DOCUMENTS

| | | | | |
|---|---|---|---|---|
| 6,761,643 | B2 * | 7/2004 | Boatwright | 473/2 |
| 6,875,120 | B1 * | 4/2005 | Ellis | 473/2 |
| 7,050,078 | B2 | 5/2006 | Dempski | |
| 7,063,620 | B2 * | 6/2006 | Nearhood | 473/2 |
| 7,118,486 | B2 * | 10/2006 | Evers | 473/2 |
| 7,384,341 | B2 * | 6/2008 | Martin et al. | 473/27 |
| 2003/0059752 | A1 * | 3/2003 | Gratkowski et al. | 434/247 |
| 2004/0104935 | A1 | 6/2004 | Williamson et al. | |
| 2005/0064936 | A1 * | 3/2005 | Pryor | 463/36 |
| 2006/0267952 | A1 | 11/2006 | Alcorn | |
| 2007/0026956 | A1 * | 2/2007 | Pearson | 473/1 |
| 2007/0184908 | A1 * | 8/2007 | Hansen | 463/49 |
| 2008/0111310 | A1 * | 5/2008 | Parvanta | 273/309 |
| 2008/0129704 | A1 | 6/2008 | Pryor | |
| 2008/0132332 | A1 | 6/2008 | Pryor | |
| 2008/0191864 | A1 * | 8/2008 | Wolfson | 340/524 |
| 2008/0220887 | A1 * | 9/2008 | Evans et al. | 473/2 |
| 2008/0269925 | A1 * | 10/2008 | Lita | 700/92 |
| 2009/0054168 | A1 * | 2/2009 | Bilgen et al. | 473/1 |
| 2009/0280916 | A1 * | 11/2009 | Zambelli | 473/74 |
| 2009/0286610 | A1 * | 11/2009 | Schofield, Sr. | 473/1 |
| 2009/0302533 | A1 * | 12/2009 | Smith | 273/108.1 |
| 2010/0004062 | A1 * | 1/2010 | Maharbiz et al. | 463/36 |
| 2010/0178994 | A1 * | 7/2010 | Do et al. | 473/2 |
| 2010/0279757 | A1 * | 11/2010 | Glenn et al. | 463/17 |
| 2011/0021256 | A1 * | 1/2011 | Lundback et al. | 463/2 |
| 2011/0021257 | A1 * | 1/2011 | Lundback et al. | 463/2 |
| 2011/0022202 | A1 * | 1/2011 | Lundback et al. | 700/92 |
| 2011/0070960 | A1 * | 3/2011 | Greenspan | 473/2 |

OTHER PUBLICATIONS

"Snooker Robot Player—20 Years On" written by Ho, et al., published by Computational Intelligence and Games, available on or before Jun. 4, 2007, pp. 1-8.*

"Grey decision-making for a billiard robot" written by Lin, et al., published by IEEE at International Conference on Man, Systems and Cybernetics, available on or before Mar. 7, 2005, vol. 6, pp. 5350-5355.*

"Support System for pocket billiards" written by Takahashi, et al., published by IEEE at SICE Annual Conference 2008, available on or before Oct. 21, 2008, pp. 3233-3236.*

"A Vision Based Interactive Billiard Ball Entertainment System" written by Shih, et al., published by IEEE at Digitel 2007, available on or before Apr. 10, 2007, pp. 200-202.*

"An Interactive and Immersive 3D Game Simulation Provided with Force Feedback" written by De Paolis, et al., published by IEEE at 2008 First International Conference on Advances in Computer-Human Interaction, available on or before Feb. 25, 2008, pp. 26-30.*

* cited by examiner

ENTERTAINMENT SYSTEM PROVIDING DYNAMICALLY AUGMENTED GAME SURFACES FOR INTERACTIVE FUN AND LEARNING

BACKGROUND OF THE INVENTION

1. Field of the Invention

The present invention relates, in general, to interactive games with physical and/or tactile game or playing surfaces such as billiards, bowling, and similar games where users or players interact with or move game components or objects on a game or playing surface, more particularly, to systems, devices, and methods for augmenting, enhancing, or changing one or more game surfaces of an interactive game with augmentation content that may include projected media or projected portion (such as video images selected or generated in response to player interaction with the game surfaces) and may also include an audio portion.

2. Relevant Background

Recreation and entertainment centers continue to be popular around the world with attendance only expected to increase in the coming years. Traditional games such as bowling, billiards/pool, ping pong, and air hockey are still typically provided at such entertainment centers along with pin ball machines and video games. The table top games and other conventional games such as bowling may be thought of as the original interactive games as they allow a player to interact with a physical and often three dimensional (3D) game or playing surface such as by moving one or more game components or elements (e.g., using a cue to move billiard balls about an upper surface of a table).

While considered fun by many, traditional interactive games such as bowling are often being replaced by video games and higher end game experiences. For example, air hockey games often are replaced in entertainment facilities with video games and even with virtual reality systems and simulators such as flight simulators or interactive sports games (e.g., boxing, soccer, and other simulation games that allow a user to interact physically with a video game console/display). In many ways, game enthusiasts' expectations are being heightened by the game play experience provided by video games.

Traditional games such as pool and bowling tend to rely on competitors that are trying to enhance their skills or improve their scores or on new participants for continued use or any increases in popularity; however, the trend continues away from such games. Some attempts have been made to retain interest in traditional games such as bowling. For example, many bowling facilities have times set aside when special music and lighting effects are provided such as dance or disco music and spot lights, flashing lights, and disco light effects in an otherwise darkened area by the alleys. In other cases, static images such as logos are projected on or near play surfaces such as one or more lanes or on a wall near the game surfaces. These lighting and sound effects typically provide little variation and allow no user interaction or input with regard to the effects and have had only limited success in creating new or renewed interest in playing traditional or original "interactive" games.

SUMMARY OF THE INVENTION

The present invention addresses the above and other problems by providing methods and systems for enhancing or augmenting game or play surfaces of a game structure/platform such as an upper or side surface of a pool table, a lane in a bowling alley, nearly any wall or floor surface of a racquetball court, on the lane or a vehicle on a race course, and the like. These surfaces and game objects on such game surfaces may be enhanced by projecting a digital overlay (or themed image(s)) that is mapped to the size and shape of the game surface as well as the current location/position of one or more game objects, which may be determined using one or more tracking mechanisms. In other words, embodiments of the invention may be thought of as providing a new layer of entertainment and interactivity that is layered via projection of a still (or static) and/or moving image onto the existing game platform to increase user enjoyment as well as the desire to play again so as to increase repeat play.

For example, a teaching overlay may be provided on a pool table that shows a player a next best shot including which ball to hit into which pocket next, along with a target or guide path for the cue. In another example, a bowling lane may be enhanced by tracking a moving ball to allow a projected image on the lane and ball to show the ball as a ball of flames that leaves a torched path on the lane and causes an explosion as it hits the pins. These and other aspects of the game augmentation systems described herein may be used to provide truly unique and interactive feedback to game players as the game surface (or projection surface/portion of the game surface(s)) is changed based on player preferences (such as based on a user's/player's selection of an overlay template and a player's setting one or more parameters for the chosen template), based on a game mode, and/or based on player actions that may cause game objects to move relative to the game surface. The system (and associated method) may provide true personalization of the game experience as the player may select a template from game system memory/data storage that matches their preferences.

Additionally, real time interaction and feedback may be provided as the players play the game, which dramatically enhances the overall game experience. Repeatability is increased because the game may be modified numerous times to be different (at least in its digital augmentation) each time the player plays the game. The system/method may provide learning opportunities as players may choose to visually preview what the game control system (software modules) determines as an optimal next action/play at a specific point of a game (e.g., dynamic/real time augmentation by altering the projected image based on player interaction and current locations of game objects and present game state). Learning and enjoyment may also be increased by the system operating to record/store prior moves or plays, which may be displayed on the game surface for review by the player (e.g., show a player where they actually hit a cue ball and the result versus the suggested path provided as a preview of the suggested next shot). The game augmentation system may also store players and player preferences so as to allow this information to be used to enhance later game playing opportunities (e.g., store a previously selected/configured overlay template, a preferred game mode such as teaching mode or skill level such as beginner/novice, intermediate, expert, and so on, and game data such as scores and game status which may include location of game objects on the game surface to allow the player to reset the previous game).

More particularly, a system is provided for visually enhancing a game, with the game typically taking the form of a game structure providing a game playing surface (such as a pool table, a miniature golf course, a bowling alley lane, and so on) with game play including moving one or more game objects (such as game pieces and user-manipulated implements such as sticks, paddles, clubs, and so on). The system includes a projector that projects digital augmentation content or images onto the game surface (e.g., the augmentation content may include a themed background static/animated image that is mapped to the surface and its 3D topology). The system includes a tracking mechanism that generates tracking data from monitoring of the game surface and/or game objects, with the tracking data defining positions of the game objects relative to the game surface. The system further includes a controller (or computer with a processor running one or more software/logic modules to perform the described functions) that processes the tracking data to determine the positions of the game objects. The controller then acts to update or modify the augmentation images (or to render a new augmentation content) in response to the determined positions of the game objects. The system may also include a user/player input device or console that is operable (such as via a user interface) to select their game preferences, game modes, parameters, and so on, with the controller operating based on this input.

In some cases, the augmentation images include a composite digital video stream made up of a base image that is mapped to the game surface and also a game object enhancing image that is mapped to one of the game objects (such as a game piece or a user implement) and its current/determined position, such that projection of the augmentation image results in the one game object being digitally enhanced with an overlay image. In some cases, the tracking mechanism may be used to track movement of this one game object such that the overlaying of the enhancing image may be provided even as the game object moves relative to the game surface. Additionally, a second object enhancement image may be included in the augmentation images in the form of a trail/trailing image with the controller determining a path traveled or followed by the tracked game object relative to the game surface and then positions the trail image to be mapped to the position of the traveled path (e.g., a series of sparks or flame following a rolling flame ball image projected upon a ball or other game piece). Further, the controller may detect game piece collisions/changes of direction at which point or location a related animated effect may be rendered on or near the game surface.

In some embodiments, the augmentation images or content includes a training component or portion that is projected on or near the game surface, and the training content may be generated or at least selected based on the current positions of the tracked game objects. The training component of the projected images may include graphical components that define a recommended next move or shot as determined by the controller based on the positions of the game objects, and the training component may also include images that define a path that one of the game objects is suggested by the controller (or its software) during the recommended next move. In other embodiments, the augmentation images include a predictive outcome component including animated images showing a resulting movement of one of the game objects caused by a suggested interaction by the player with the game surface or the game objects.

The controller may act to determine game data such as scores, a next turn, or the like based on the positions of the game objects, and the modifying of the augmentation content/images may include providing the game data for projection on or near the game surface (such as in a game data display). The system may include memory or data storage that stores a set of game templates defining themed overlay images for the game surface. The controller may then function to receive user input selecting (and, in some cases, configuring) one of these game templates and then generating the augmentation images based on both the selected overlay images and the determined positions of the game objects.

DETAILED DESCRIPTION OF THE PREFERRED EMBODIMENTS

The following description is generally directed toward a game augmentation system (and corresponding methods) that provides a variety of techniques for digitally augmenting or providing thematic overlays of imagery on game surfaces and/or game elements and objects that may be moved upon such game surfaces. The game surfaces may be existing, typically non-electronic or powered, surfaces such as the top of a pool table or a lane of a bowling alley, e.g., game structures or platforms that may be used to play a conventional game without use of the augmentation system or upon loss of power (e.g., typically not a monitor or screen as may be provided for a video game). In some cases, a projection/camera system is included that is oriented and/or mapped relative to the game surface and that includes components for projecting an image or overlay onto and read tracking information from the gaming surface.

The digital augmentation or projected images may include a video from a digital media file that is particularly suited for the projection surface(s) provided by one or more surfaces of the game structure, e.g., various layers along with game objects that provide a three-dimensional (3D) projection screen or surface. The digital media file or augmentation images/overlays may include a variety of static, dynamic, and/or interactive images that may be updated based on tracking information (e.g., movement of the game pieces or objects) to provide dynamically changing or real time interactive images that are layered onto the 3D gaming surface. The augmentation images/overlays may be chosen by players such as via selection of one or more templates for games that may be further configured by entry of player preferences and by selection of game play modes. Tracking is performed on an ongoing or at least periodic basis during game play such that the projected overlay image may be updated to reflect changing positions of game pieces or objects, and the updated overlay image may include images projected on moving game pieces or objects as well as special effects (e.g., flashes of light when a pool ball drops into a hole, explosions as a bowling ball strikes pins, and so on) and/or other game data such as learning/teaching tips in a learning portion of the projected overlay image, game state information such as an updated score in a game data portion of the projected overlay image, and other image elements. The updated image may be rendered or generated dynamically in response to tracking information from a tracking device used to track movements/positions of game pieces or objects. In some embodiments, the augmentation system and method is used to enhance use or play with an existing game structure that may be used with conventional game play, rules, and objectives while the overlayed image provides a new layer of visual enhancement that may significantly effect and improve the user's experience.

Figure 1:
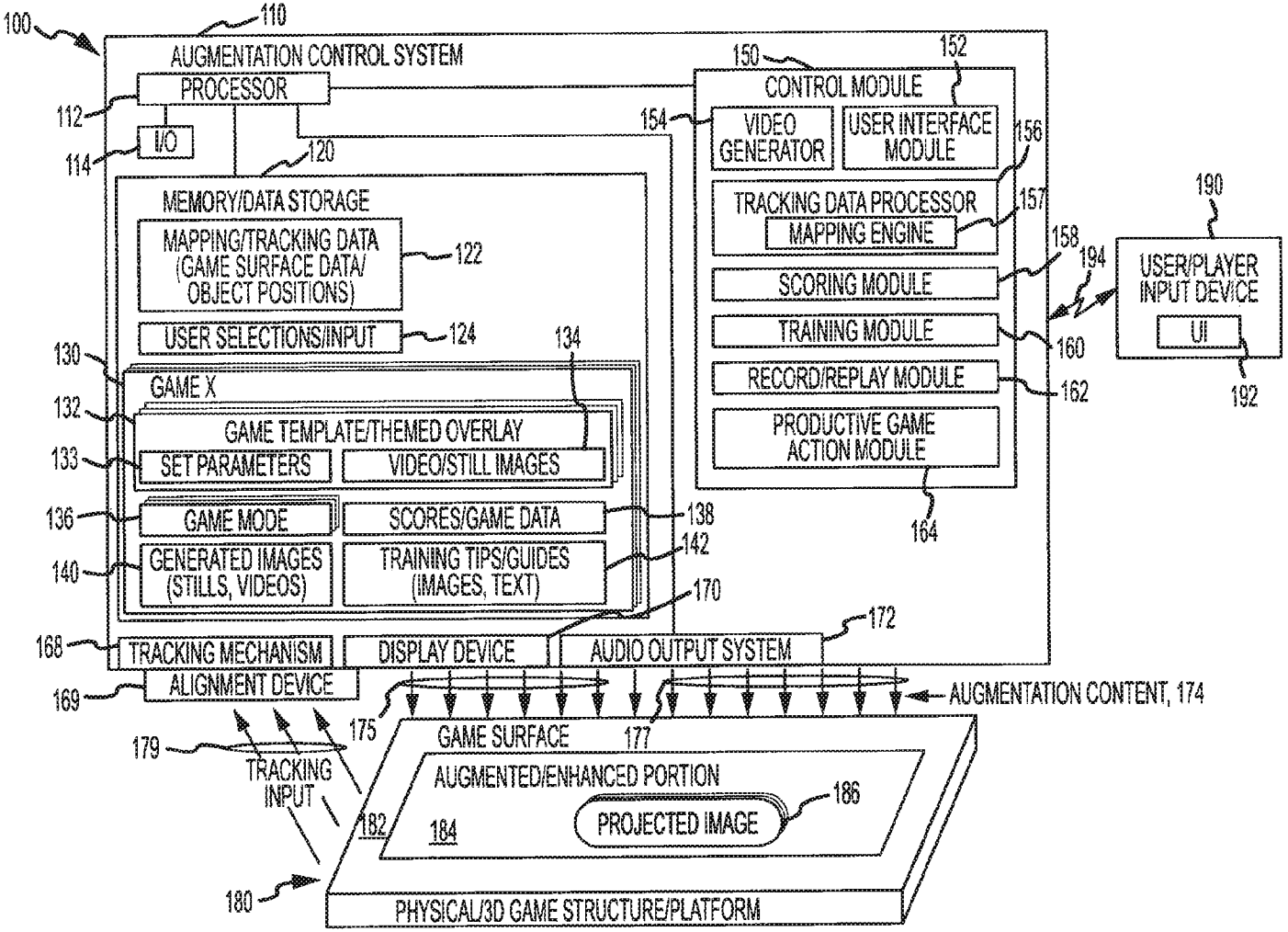
FIG. 1 is a functional block diagram of an entertainment system for digitally and typically dynamically enhancing or augmenting a game surface such as with a themed overlay that may be modified during game play in response to user actions, to provide tips/learning regarding the game, to provide selected effects, and/or to otherwise create a more desirable game playing experience.

FIG. 1 illustrates a game augmentation system 100 that may be used in some embodiments to dynamically enhance or augment a game surface with augmentation content that may include a video stream that is digitally mapped or aligned with a projection surface on the game surface. As shown, the system 100 includes an augmentation control system 110 that may be implemented using one or more computer, electronic, and data storage devices provided in a single housing or communicatively linked (in a wired or wireless manner) together to facilitate digital data transfer. The system 110 may include, for example, a processor 112 that runs or manages operation of input/output devices 114 such as a monitor with a graphical user interface (GUI) with or without a touch-screen, a keyboard, a mouse, a printer, and so on that allow an operator of the system 110 to provide input and/or check operating status of the system.

The processor 112 also manages storing and retrieving of data from memory or data storage 120. The memory 120 is used to store a variety of data or information that is used to provide the game augmentation experience described herein. For example, the memory 120 may be used to store mapping and tracking data 122 that may define a size and shape of a game surface 182 as well as its distance (depth) from the output of the control system 110 (e.g., a tracking mechanism 168 may be positioned adjacent or proximate to a display device 170 output). The tracking data 122 may also include data indicating a current position of each of a number of game objects such as game pieces (such as balls, pins, darts, and so on) and user implements (such as paddles, cues, and so on used within a game to interact with the game pieces). The software modules run by the processor 112 such as the video generator 154 and/or scoring module 158 will include logic for updating the video/still images 134 and other game data such as scores 138 based on the determined/tracked object positions (or tracking data) 122. The memory 120 also is used to store user selections/input 124, which may be provided via wired or wireless communications 194 from a user/player operating a user/player input device 190 such as via a UI 192. The user selections 124 may include selecting a game to play as well as a game template for that game (e.g., the fire version of the selected bowling game) and parameters for that template as well as a game mode (such as beginner/teaching mode, predictive mode, and so on).

As shown, the memory 120 may further be used to store data for a set of differing games 130 (or these, of course, may be provided in cartridges or similar devices well known/used for video games that may be inserted into the system 110 for access by processor 112). For example, the memory 120 may be used to store a number of games 130 that a user may select such as pool, ping pong, darts, and so on (or the system 110 may be used for one game structure 180 at a time and/or for one implementation). In many cases, though, the memory 120 is not used to store different games as the game and related digital augmentations may be specific to the table 180 and/or game surface 182. In other embodiments, memory/cartridges may be used to store different or provide new templates or versions of games 130, and these games 130 on such memory or cartridges 120 may be played on a single table 180 such as 8-ball, 9-ball, snooker, and the like on a pool table 180.

With reference to each game 130, one or more game templates 132 may be provided that store data defining an themed overlay including any default or user-selected parameters 133 (such as colors for game objects, patterns for a background image such as for a pool table surface, and so on) for the themed overlay 132 and a set of video and/or still images 134 that may be used by a video generator 154 to generate the video portion 175 of the output augmentation content 174. Some games may have more than one operating mode and such game mode data 136 (which typically would be user selectable via device 190) may be stored in memory 120, too, and such game modes are described in more detail below. The memory 120 may also be used to store scores and other game data 138 that may be created in real time and provided as part of the augmentation content 174. Further, the memory 120 may store generated/rendered images 140 to be provided in the augmentation content 174 (such as images rendered/generated by generator 154 from base images 134, recorded images of game surface/objects 182, previously displayed images such as previously displayed predictive images, and the like). Still further, the memory 120 may store training tips/guides 142 such as training images, text, and so that may be displayed in the augmentation content 174 such in a training game mode 136.

The processor 112 may be used to run a control module 150, which may be software or logic that is provided in nearly any computer readable medium and used to cause the processor 112 or control system 110 to perform the functions taught or suggested herein to provide digital augmentation of a game surface 182. For example, the control module 150 may include a user interface module 152 adapted to generate and/or process data from the UI 192 of the user/player input device 190 so as to store user selections/input 124 and/or to allow selection of a game 130 and a corresponding game template 132 and game mode 136.

The control module 150 may also include a video generator 154 that functions to create a video portion 175 of the augmentation content 174 that is provided via a display device 170 such as to create generated images 140 (e.g., a video stream that is rendered to include a base image displayed on the game surface 182 as well as one or more dynamically generated components that are projected onto the game pieces/objects and/or the game surface such as to provide a dynamic special effect to enhance the game play). Dynamic or real time generation of video images 134, 140 by a video generator 154 may be performed in any well-known or later-developed manner, e.g., using off-the-shelf image generating software, firmware, and/or hardware. However, a significant aspect for some embodiments is that the augmentation content 175 provided by video generator 154 is both mapped to the game surface 182 and also updated or generated at least in part in response to tracking data 122 that is used to determine interaction by a player with the game surface 182 via game implements as well as movement of game pieces.

In other words, the video generator 154 takes as input not only image data from the game template/themed overlay 132 but also the mapping/tracking data 122 that is collected as shown at 179 from the game surface/objects 182 via tracking mechanism 168. In this regard, the control module 150 may include a tracking data processor 156 with a mapping engine 157 for mapping a digital image created by the video generator onto the game surface 182 and any game objects/pieces on the surface 182. Generally, the data processor 156 may perform both mapping and tracking as both are useful in implementing the invention. Mapping by the engine 157 may include figuring out and aligning the coordinate spaces of the game surface 182, the projection device 170, and the tracking device 168. This may also be known as calibration. A "mapping" (included in mapping data 122) is generated by engine 157 between all three of these devices so that the control module 150 can determine or know the relationship between a point on the game surface 182, a pixel coordinate in the projector 170, and a measured positioned in the tracking space (which may also be stored in or be a part of data 122 utilized by processor 156 and/or control module 150). This is performed before the tracking data 122 may be used to place augmented images (such as by video generator 154 providing images/data/text 134, 138, 140, 142 in images 174) in the projection device(s) 170 to display on game objects 184 on surface 182 as projected images 186. Automatic projector mapping may be performed using technologies available for example from product developers/distributors including Mersive Technologies (www.mersive.com), Scalable Display Technologies (www.scalabledisplay.com), and/or the like. Auto calibration may be performed in a variety of ways such as using techniques published or provided by UC Irvine by Aditi Majumdar (see, for example, www.ics.uci.edu/~majumder), University of Kentucky by Dr. Ruigang Yang (see, for example, www.vis.uky.edu/~ryang), and/or others. Vision-based tracking systems may be used for mechanism 168 such as those that use video images, color, and/or feature detection such as the Eye Toy distributed by Sony Computer Entertainment America Inc. (see, for example, www.us.playstation.com/PS2/Games/EyeToy_Play/ogs), CamSpace distributed by Cam-Trax Technologies (see, for example, www.camspace.com), Project Natal provided by Microsoft Corporation (see, for example, www.xbox.com/en-US/live/projectnatal), or the like.

For example, the game surface 182 may be an upper surface of a ping pong table that is a certain distance away from the display device 170, and the tracking input 179 (and data 122) may be processed by the tracking data processor 156 to determine how to map via engine 157 a video 134 for a game template 132 onto the game surface 182 in an augmented/enhanced portion 184 as projected images 186. Further, moving game objects such as balls may be tracked by the tracking mechanism 168 and tracking data processor 156 to determine tracking/mapping data 122 that may be used by video generator 154 in creating augmentation content 175 that includes an image component that is overlayed or projected upon the moving game object via display device 170.

The tracking/mapping of the game surface 182 may be performed using one or more presently available (or later developed) spatial measurement technology and tracking techniques, e.g., a 3DV Z-Cam or a secondary camera sensing a structured light pattern being projected on the projection surface. In some cases, the tracking mechanism may be a camera based system that is used to gather the mapping/tracking data 122 regarding the game surface and object positions in real time. For example, the tracking mechanism 168 may include a high speed camera with retroreflective markers provided on the game surface 182 and/or upon game objects (e.g., player implements, game pieces, and so on) such as an OptiTrack™ system available from NaturalPoint, Inc. In other embodiments, the mechanism 168 may utilize infrared LEDs with markers on game surfaces and/or objects and high speed cameras such as by including an Impulse motion capture system available from PhaseSpace Inc. or the like. In other cases, the mechanism 168 may include projectors that output encoded patterns at high speeds combined with photosensing marker tags on game surfaces and/or game objects such as by using a MERL LumiNetra device/system or the like. In other cases ultrasonic or magnetic techniques may be used to implement the tracking mechanism 168 and collect the tracking data that defines a current location of game objects on or near the game surface 182 for use in by the video generator 154 in updating or rendering an overlay image that includes game object components that may be projected upon the game objects and/or to track/determine game data such as scores and other game data 138 based on movement of the game objects relative to each other and the game surface 182.

The control module 150 may further include a scoring module or logic 158 that processes the mapping/tracking data 122 from the tracking mechanism 168 to determine a game score 138 and/or other game data such as which player should have a next turn in the game (e.g., a failure to sink a pool ball may be tracked and a next player indicated as having the next turn). A training module 160 may be included to selectively retrieve training tips/guides for a game 130 and to provide this data 142 to the video generator 154 during particular game modes 136 and at particular times in a game play based on tracking data 122 to provide training in game play to a user/player of augmentation system 100 (e.g., to retrieve images/text indicating how to hit a next shot in pool, to bowl a ball to pick up a spare in bowling, and so on).

The control module 150 may further include a record/replay module 162 with logic that may be run by processor 112 to selectively record actual play images 140 (such as with a camera provided as part of the tracking mechanism 168 or separately that is aligned via alignment mechanism 169 with game surface 182) for replay or to store preciously displayed images/video created by video generator 154 for later replay via display device 170 upon the game surface 182. Additionally, the control module 150 may include a predictive game action module 164 that processes current status of game data 138 (such as whose turn it is to play in a game) and mapping/tracking data 122 (such as a measured position of all game objects in the tracking space, the mapping between the coordinate surfaces of the game surface, the projection device, and the tracking device 168) to generate one or more next plays, how these should be played/performed/initiated, and a likely outcome or result (e.g., a player may toggle through a set of possible next shots in a billiards game with the augmentation content 175 being updated via the predictive game action module 164 and video generator 154 to show how to perform a shot with a cue, a cue ball, and target ball/pocket as well as likely outcome (e.g., where the target ball will travel to on the game surface and where the cue and other balls will travel after struck)). Other logic or software modules may be included in control module 150 as useful to perform the functions of the augmentation system 100 and methods described herein.

The system 100 includes a physical or 3D game structure or platform 180 that may include a table-type game and associated components such as a ping pong table, air hockey table, pin ball machine, or the like or a larger platform such as lanes in a bowling alley, a tennis court, a go kart track, mini-golf course, or the like. The platform 180 includes a game surface 182 upon which a set or number of game objects such as game pieces and player implements that are to be used to play a game such as a game of air hockey, miniature golf, and so on or near the game surface. During use of the system 100, an augmentation content 174 is output to enhance the game play, and the content 174 may include an audio portion 177 from an audio output system 172, which may create sound effects based upon tracking data or to correspond to a visual portion 175 (e.g., to provide a sound suited to a displayed image such as a booming noise upon display of an exploding game piece or collision between game pieces/objects). The audio component 172 may be operated by the control module 150 to output or play audio files or segments (not shown) stored in memory 120, and these audio files/segments may be triggered in response to tracking input 179 (such as based on user interactions and/positions of game pieces on game surface 182). The output may be included in the augmentation content 174 as audio output 177 and may be template appropriate audio files that correspond to the projections 175 to further enhance the experience (e.g., an explosion when two pool balls collide, the sound of fire when a flaming ball moves down a bowling alley, a person speaking to provide training tips, a crowd cheering upon a good shot/play or jeering upon a bad shot/play, and so on).

The game platform 180 may take nearly any form that provides a game surface 182 upon which a game is played such as, but not limited to a pool table, a bowling alley, shuffle board court, a ping pong table, an air hockey table, a pin ball machine, a skee ball lane, a dart board and nearby surfaces, miniature golf course, table bowling, a go kart track, and the like. Mapping and calibration of the location of the surface and game objects relative to the projected augmentation content may be done automatically based on reflective or tagged elements on the game surface and/or game objects (such as player-manipulated implements (such as paddles, sticks, and even their body such as their hands with a glove or their feet with markers on their shoes) and game pieces (such as balls)). The marking and tracking of the game objects by a camera system or other tracking mechanism allows for real time analysis, projection overlay, and recording of game play (such as for later play back or analysis).

The augmentation content 174 also includes a visual portion 175 that is provided by a display device 170 including outputting a digital image stream from video generator 154 such as based on the game template/themed overlay 132. The system 100 may use a display device in the form of a projection assembly that takes digital images from memory 120 or video generator 154 (e.g., still or motion image files such as in the JPEG, MPEG, or other formats) from the control assembly and projects images 186 onto the projection screen or augmented portion 184 of game surface 182 (with portion 184 typically including game objects such as game pieces and player implements such as a cue stick, a tennis racket, a go kart, or the like). The projector/display device 170 may be supported over the game surface 182, such as with the outlet or lens of a projector directed toward the portion 184 and aligned via device 169 (with its output mapped to the shape and size of the surface 182 and to suit a distance between the projector output and the surface 182) or otherwise focused to provide a desired projected image 186. The projector of display device 170 may take numerous forms to practice the system 110, and, for example, may be a DLP (digital light processing), LCD (liquid crystal display), LCOS (liquid crystal on silicon), or other technology-based projector or video projector with a wide range acceptable definitions (e.g., high definition may be used but is not typically required in system 100). In other cases, the display device 170 may be provided as part of the game surface 182 such as to provide all or portions of the augmented or enhanced portion 184 such as with a flat screen display device or the like used to display digital images and also to provide part of the game surface 182.

With the general components and operation of a game augmentation system such as system 100 understood, it may be useful to discuss a number of the ways such a system may be operated to affect and improve the user experience. For example, a projection/camera system that is oriented and mapped to project and read information from the gaming surface may be used in combination with control logic and stored game data/media files to provide a variety of static, dynamic, and/or interactive real time overlays and effects on an actual or conventional game surface in response to player input/selections and preferences and based on ongoing play that is tracked and processed by the control logic. In some cases, the game templates or themed overlays may be customizable and selectable by a user or player of the augmentation system. Each template or overlay may be adapted to provide (when processed by control logic such as a video generator) to provide a themed overlay image that may be projected onto the 3D game surface and objects on or near the surface. The overlay image may be static or include animated/moving portions with digital images and/or computer-generated/rendered images. For example, the templates may be adapted to provide theme or aspects that provide or represent snow, ice, fire, water, celestial aspects such as a moon, a sun, meteors, and so on, and nature-based features such as vegetation, terrain, and animals. Themes such as event-based images may be provided such as a birthday. Graphics maybe included in the overlay and defined in a game template such as logos, advertisements, and the like. Additionally, the overlay may color the game surfaces and objects or otherwise change their appearance such as by applying a pattern onto game piece or onto a part of the game surface.

The augmentation system may be operated to provide real time special effects that may be template or game specific. The special effects may be provided in the augmentation content in reaction to game play that is monitored by the tracking mechanism/system so as to enhance the user experience. For example, a game template may call for explosions to occur when a particular game piece strikes another game piece or a feature of the game surface (such as when a pool ball falls into a pocket or an air hockey puck goes into a goal). In other cases, the special effects or overlay components may include surface dents on the game surface, cracks in the game surface/table, motion trails or blurs that follow moving game objects, confetti cannons that are displayed on the surface and then fired in response to a determined game event (e.g., a goal being scored), virtual ball or other game object collisions, and so on.

The augmentation system may also be adapted to record and replay prior game play or game aspects (such as previously presented training tips/predictive actions) on the game surface. This feature, for example, may allow the system to be operated such as in response to a player selection to provide instant replay of a player's turn or other game activity, slow motion replays of past game action, watch prior play with tracked movements in reverse or with backward motion to original or pre-turn positions, and the like. The replay elements may be used to compare an actual turn or game play with an optimal or suggested turn provided by the augmentation system prior to the turn (or afterwards). The recording of game play may also be used to determine/monitor trends in a player's game play or skills and to report these to the player (e.g., hitting cue ball off center, rolling bowling ball to the right of target, and so on).

The augmentation system may also be operated so as to provide dynamic calculation of a likely result of a player's planned next move based upon player's intent and preparation for a next turn. Then, based on such calculations, the augmentation content may be updated to include a predictive visualization of the results of the planned actions. For example, a player may line up for a shot in a pool game including placing their cue stick relative to the game surface and remaining target balls and the cue ball. The system may then calculate and display as part of the projected augmentation content the likely travel of the cue ball and collision paths of the pool balls or game objects based on the cue stick's alignment or position with the cue and a first target ball. This may occur when the player selects a predictive game mode in some implementations.

The augmentation system may also be operated in other game modes such as a beginner or teaching/training mode. In this mode, the augmentation system may operate to provide hints, tricks, optimal aim points, next best play or shots, and/or other training information that may be game-specific. Such training data may be provided with text, images, graphics, and other content that is added to the projected augmentation content on the game surface. The augmentation system may also provide automatic score keeping for a game that is being played on the game surface by processing the tracking data for the game pieces and/or game implements. Then, the augmentation content may be updated or modified to include this determined score data to provide a real time visual score keeping feature.

The control module and its associated logic and/or the game template may be used to add levels of difficulty by changing a historically static and repetitive game. For example, the augmentation content may include difficulty or skill level-based components or aspects that can be used to adjust the difficulty of play. In some cases, these skill level-based components in the projected component may include confusing motion, patterns, or elements that make it more or less difficult to perform a next game action (e.g., cause a target ball to appear to be moving, change the pattern of the table to make it appear to be sloped, place virtual objects in a path, and so on).

Additionally, the system may operate to provide augmented or enhanced scoring opportunities. For example, virtual scoring components may be included in the augmented content and interaction with these virtual scoring components may be tracked to increase (or decrease) a player's score and effect play. In one case, a player may obtain additional points if their ball "contacts" a virtual scoring component/target as well as scoring for properly performing the next turn. In another case, scoring components may be placed in a path of a player's game object (such as a cue ball, an air hockey puck, a miniature golf ball, a go kart, or the like) and points are awarded when the game object runs over or contacts the scoring component (or are subtracted if the object is not desirable). In other cases, contact with these virtual scoring components may result in special effects being added to the augmentation content (or projected images) or otherwise effect play (such as by causing a platform to vibrate, causing a go kart to speed up or slow down, causing lights of a miniature golf hole feature to flash or a hole in a table or the like to become blocked/plugged, and so on). Some of these latter examples may utilize supplemental mechanisms that are in communication with the augmentation control system to apply forces to the physical game surfaces, to operate game objects, and so on to effect game play or operation of the physical game objects.

Figure 2:
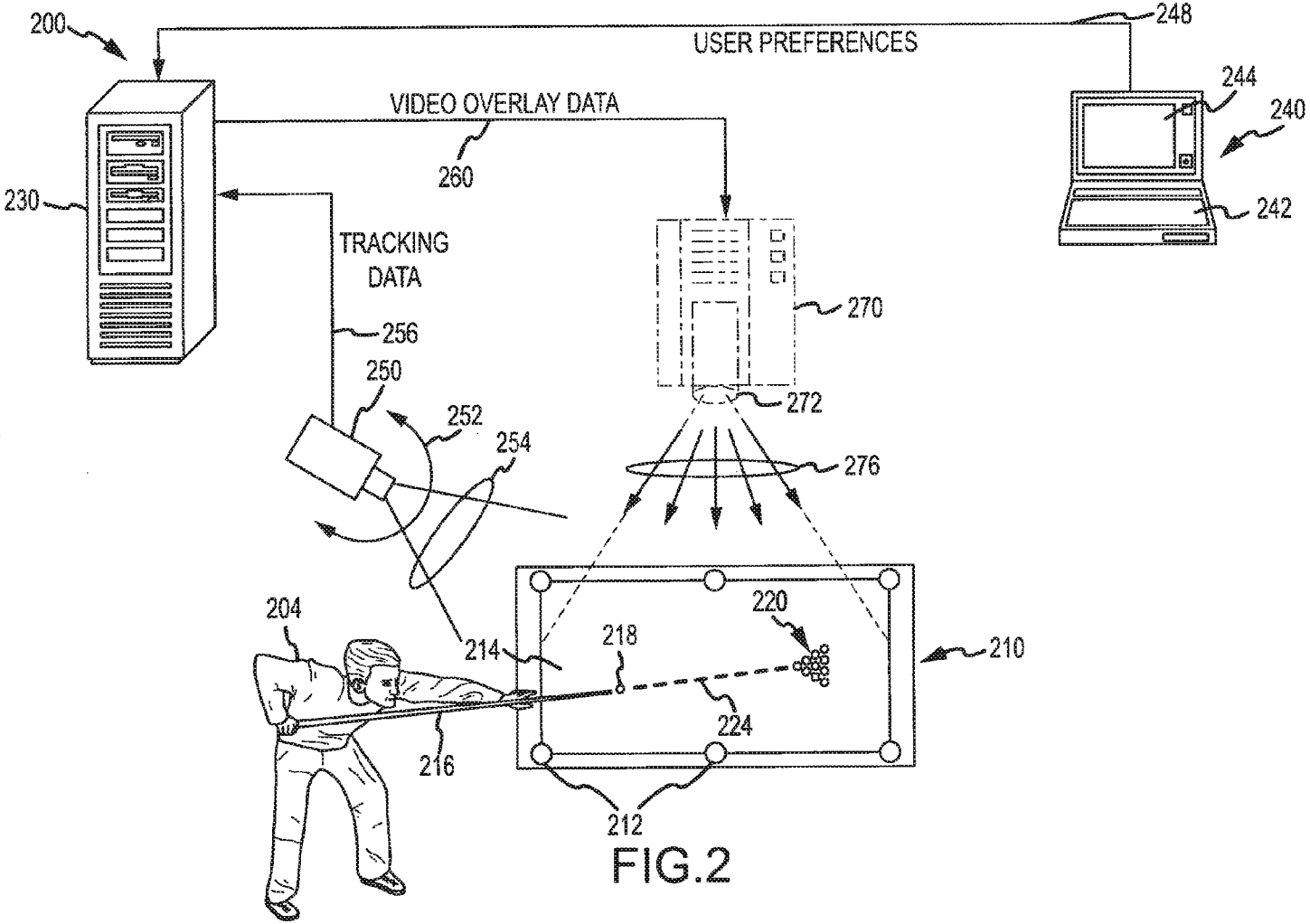
FIG. 2 illustrates a game system of one embodiment that uses a projector to digitally augment a game surface and/or game objects (e.g., surfaces of a pool table and/or balls and a pool cue) with a projected video image with moving and/or still images that are mapped to the game surface(s) and/or to tracked/determined locations of game objects.

FIG. 2 illustrates an augmentation system 200 for use in digitally augmenting a pool table 210, with billiards or pool just being one example and the pool table may be replaced with any of the game surfaces described or suggested by this description. The pool table 210 may be used by a player 204 to play a conventional game (without power or digital enhancement) or with projected image enhancement with images 276. The player 204 may use a game object in the form of a cue stick (implement) 216 to selectively strike or move another game object in the form of a cue ball (game piece) 218 on game surface 214 (e.g., 3D upper surfaces of the table 210 including pockets 212 as the image 276 may be projected onto or have components/image features that are specifically mapped to the pockets 212 as well as the planar playing surface/felt-covered portion that may also include bumpers/pads of the table 210). Additional game objects in the form of target balls (game pieces) 220 may be struck by the cue ball 218 in an attempt to cause the balls 220 to fall into pockets 212.

The system 200 includes a controller 230 that may be a computer(s) with the components shown for control system 110 of FIG. 1. A tracking system 250 is provided that may be rotated 252 to align it with the game surface 214 to receive tracking/recording input 254 from the game surface 214 and nearby areas (e.g., to monitor movement/locations of the cue 215 and other game objects such as balls 218, 220). The tracking system 250 passes tracking data (and recorded game play in some cases) 256 to the controller 230 for processing to determine the current/existing location of the game objects 216, 218, 220 and for use in generating the augmentation content 276 (e.g., projected images with still or animated images that may be computer generated/rendered in real time in response to the tracking data 256). The system 200 further includes a user interface console 240 with input devices 242 and a monitor/display 244 that allow a player/user to enter data such as user preferences/selections 248 that are passed in wired or wireless communications to the controller 230. The controller 230 processes this user input 248 to select a game template or overlay, to set parameters for the overlay, to set a game play mode, and to set other game data such as skill level and past play states.

The system 200 further includes a projection system 270 with an output 272 that is operable to use video overlay data 260 from the controller 230 (again, provided in a wired or wireless manner) to project the augmentation content 276 onto the game surface 214. Typically, the video overlay data 260 includes a video stream with background or base images that are used to digitally enhance the game surface 214 such as by changing its color, applying patterns, creating a game play theme, and the like. Further, the video stream 260 used to create the projected images 276 may include training portions/components and/or predictive portions/components such as the projected guideline 224 that shows where the cue ball 218 may travel if the player 204 continues with the shot they are lining up as is determined by the controller 230 based on tracking data 256 collected as shown at 254 for the cue 216 and cue ball 218 in real time or in their present/current positions relative to the surface 214.

Figure 3:
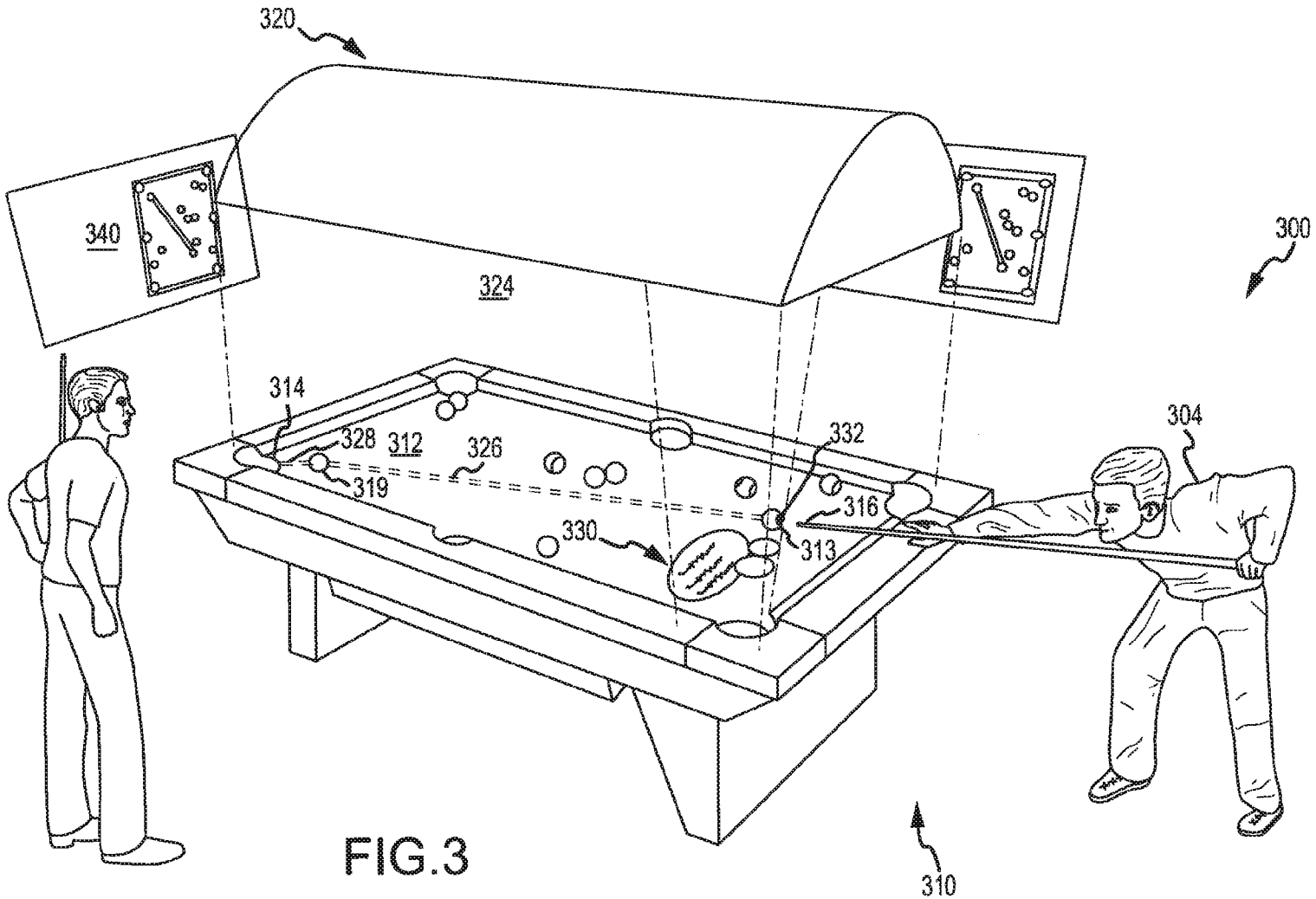
FIG. 3 illustrates a perspective view of a game system of a billiard or pool embodiment showing use of aspects or features described herein to provide a predictive visualization overlay or theme on the game surface and also for displaying game data on a nearby surface (e.g., a wall) and teaching data on the game surface and/or on game objects (e.g., a target on the cue ball in this example)

FIG. 3 illustrates another embodiment of a game system 300 that may be used in a table-top game setting to provide augmentation of game surfaces with an augmentation control system 320. The system 320 may take the form as shown in FIGS. 1 and 2 at 110 or 200. For example, although not shown, the system 320 may include a processor for running a set of control logic/modules, memory for storing game template/overlays, a tracking mechanism for assisting in mapping a location of various game surfaces and objects to a generated and projected digital overlay (or augmentation content), and a projector for projecting the content/images 324 onto the game surfaces and game objects.

In this example, the system 300 is being operated in a predictive visualization mode (which may be a sub-mode or parameter setting of a training mode), which may have been selected by the player 304 via a user interface (not shown) of system 300. The selected mode and other game data such as the present score and game states (such as whose turn is next) may be displayed in a game data display 340 as part of the augmentation content projected on or near the game surface (with the same or differing projector devices of the system 320). In the illustrated mode, a predictive visualization of the play outcome may be calculated or determined by the logic in system 320 based on tracked positions of the game objects and then rendered/projected on the surface 312 of table 310. The system 300 includes game objects in the form of a cue or implement 316 and game pieces including a cue ball 318 and a target ball 319.

As shown, the system 320 is operated to determine a predictive visualization component that is then used to generate/render the overlay and included in the projected augmentation content 324. The predictive visualization component is generated based on the positions of the game object/cue ball 318, player interaction to position cue 316 relative to the surface 312 and cue ball 318, and position of the target ball 319 relative to pocket 314. In this example, the predictive visualization component of the enhancing overlay image 324 includes a likely path 326 that will be traveled by the cue ball 318 and, based on the orientation of the cue 316, the predicted collision path 328 of the target ball 319 on the surface 312 (e.g., into the pocket 314 in this case).

Further, as shown, the player 304 has chosen to operate the system 300 in training mode (as shown on game data display 340), and, as a result, the system 320 includes one or more training/tips components within the projected augmentation content 324. These training components/portions of projected content 324 may include an image or graphic 330 on the surface 312 that may include tips in text or graphics form to indicate a way to perform the next show (e.g., which ball to target 319 and which pocket 314 to hit it into). The training portion may also include overlays on the game objects themselves such as a target spot 332 on the cue ball 318 indicating where it should be struck with the tip of the cue 316. The specific type of training/tips information include in the projected augmentation content 324 may be varied widely to practice the invention, but it often will be selected to suit the particular state of the game being played (e.g., whose turn it is, the current score, and so on) as well as the determined positions of the game objects based on tracked data.

Figure 4:
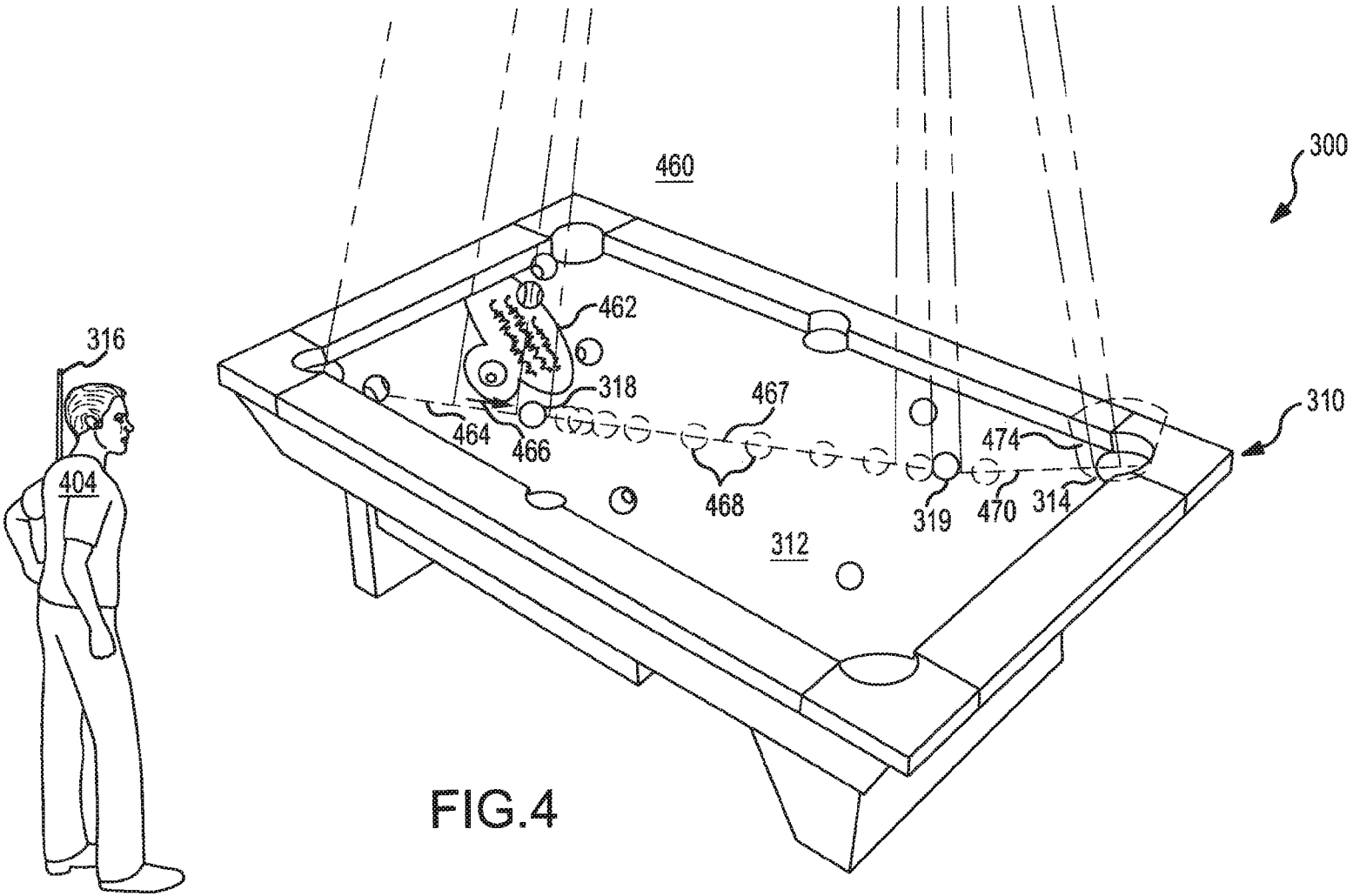
FIG. 4 illustrates the game system of FIG. 3 operating in a teaching mode to display a teaching image (e.g., with text explaining a next best move/action in the current game with, in some cases, playing tips and/or techniques) on the game surface along with a projected image showing the suggested action with the cue and determined/predicted result (including illumination of the goal pocket or target of the shot)

FIG. 4 illustrates operation of the system 300 in a teaching mode with augmentation content 460 being projected on the game surface 312 including one or more teaching/training components or portions. In the system 300, the system-generated display 460 is overlain on the table 310 to show the system-calculated ideal "next move" or "next shot". The overlay image 460 may include a first training portion 462 that includes text explaining the recommended next move/shot with words and graphics. Also, the image 460 may include a second training portion 464 that provides a recommended travel/alignment path for the game implement (or user-manipulable game object) 316 to be followed by player 404 to perform the next move/shot, and a third training portion 466 is provided showing where to move the implement 316 relative to another game object (the cue ball 318). A fourth training portion 467 is provided that shows the likely travel path of the cue ball/game object 318 after it is moved/struck by the player 404 using the cue 316 as shown. A rendered animation may be used to provide a fifth training portion showing how the game object/cue ball 318 may roll or travel on the path/portion 466 to hit the target ball/game object 319. Further, a fifth training portion 470 may be provided to show the predicted path the target/game object 319 may travel after being hit by the cue ball/game object 318. Finally, in this example, a special effect or sixth training portion 474 may be included in image 460 to enhance the gaming experience (such as by illuminating the target pocket 314 for the next shot before the shot).

Figure 5:
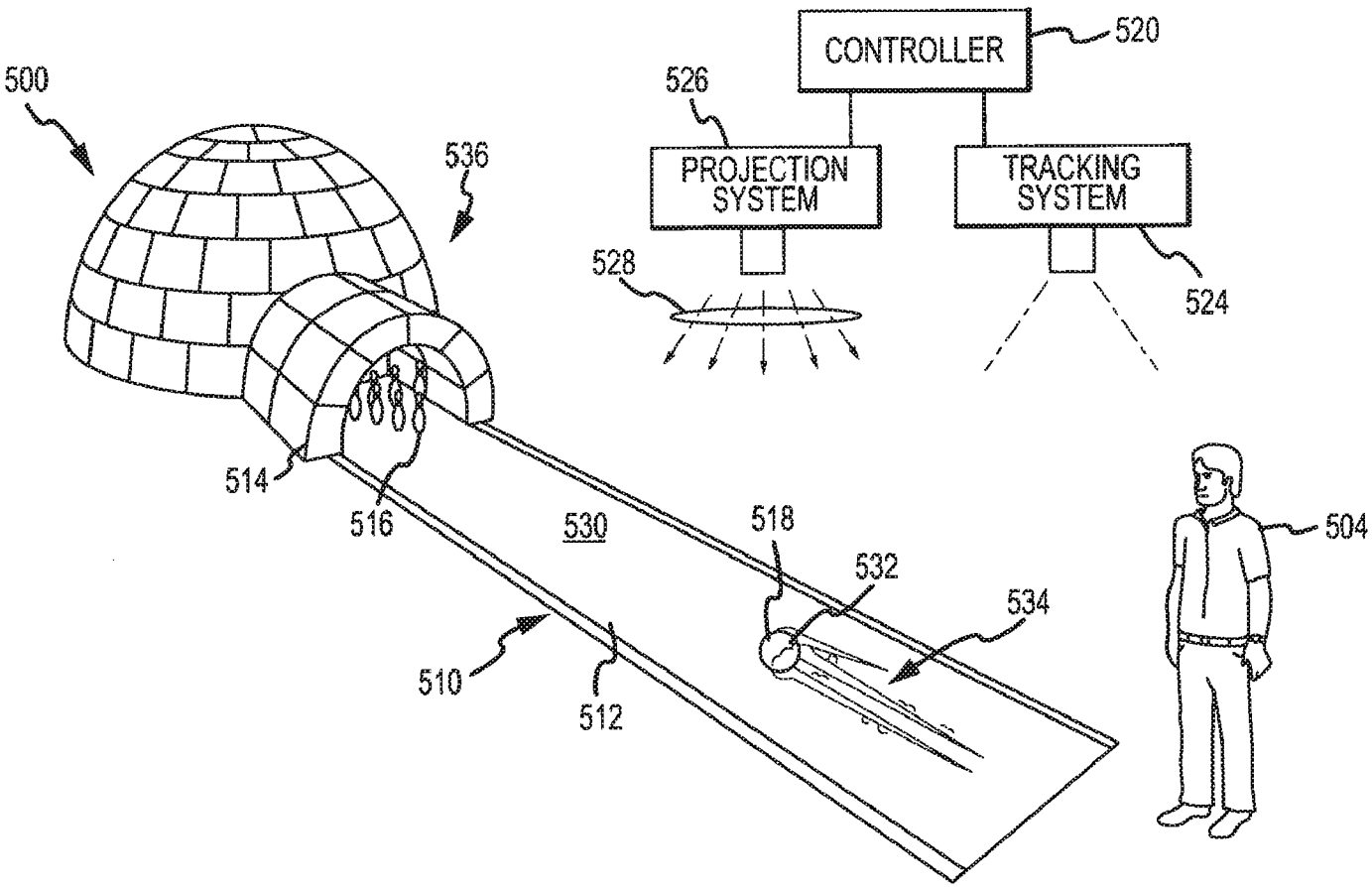
FIGS. 5 and 6 illustrate a game system of a bowling alley implementation in which a dynamic augmentation system is used to present two differing, themed overlays with corresponding digital/projected image effects (e.g., a frozen lane theme and a fire-based theme, respectively) that are updated in real time based on tracked location of a game object (e.g., of a position of a moving bowling ball on a game surface (i.e., along the lane))

FIG. 5 illustrates another implementation of a game augmentation system 500 that may be used to enhance a bowling experience. One lane 510 of a bowling alley is shown with a game surface 512 that may also include a structure 514 housing a set of game objects/pins 516 (and mechanisms for setting the pins 516). The system 500 also includes a controller 520 that may take the form shown in FIG. 1 or FIG. 2 that operates to dynamically determine interaction by a user/player 504 with the alley 510 and game objects/pins 516 via a tracking system 524 that tracks movement and position of a game object/bowling ball 518 and the pins 516 (or, in some cases, the status of the pins 516 may be provided to the controller 520 via other devices as known in the art for bowling alley automated scoring systems). Based on this tracked interaction by user 504, which may also include monitoring movement of the user 504 such as with markers on their shoes or a glove, the controller 520 generates augmentation content or images 528 that are projected by projection system 526 on surfaces of alley 510.

In other words, the augmentation content 528 may be generated based on a themed template or overlay definition and also based on tracked positions of game objects 516, 518 and user 504. For example, the game template chosen by a user 504 may be for an ice or winter theme as shown. In this case, the projected images or augmentation content 528 may include a layer of ice 530 that is mapped to the alley surface 512, an igloo image 536 overlain on the structure 514, and ice cubes/blocks applied over the pins 516 (as part of image 536 or separately).

Further, the augmentation content 528 may be dynamically updated and rendered to include a game object portion or image 532 that is projected onto the tracked/determined location or position of the game object/bowling ball 518 after it is rolled or thrown by the player 504 onto the alley surface 512. The position is tracked by mechanism 524 and the controller renders an image 532 of a rolling snow or ice ball in this themed overlay. The controller 520 further may include a trail 534 of flying snow/ice or melting ice behind the ball 518 based on a determined path/track followed by the ball 518. In this manner, the augmentation content 528 projected by the projection system 526 onto the game surfaces 512, 514 includes base or relatively unchanging portions 530, 536 that are mapped to the shape, size, contours, and the like of the game surface 512, 514, but it 528 also includes a dynamic, real time portion 532, 534 that is included based on processing of tracking information for the movement of one or more game objects 518 (or movement of user 504 in some cases such as a training mode).

Figure 6:
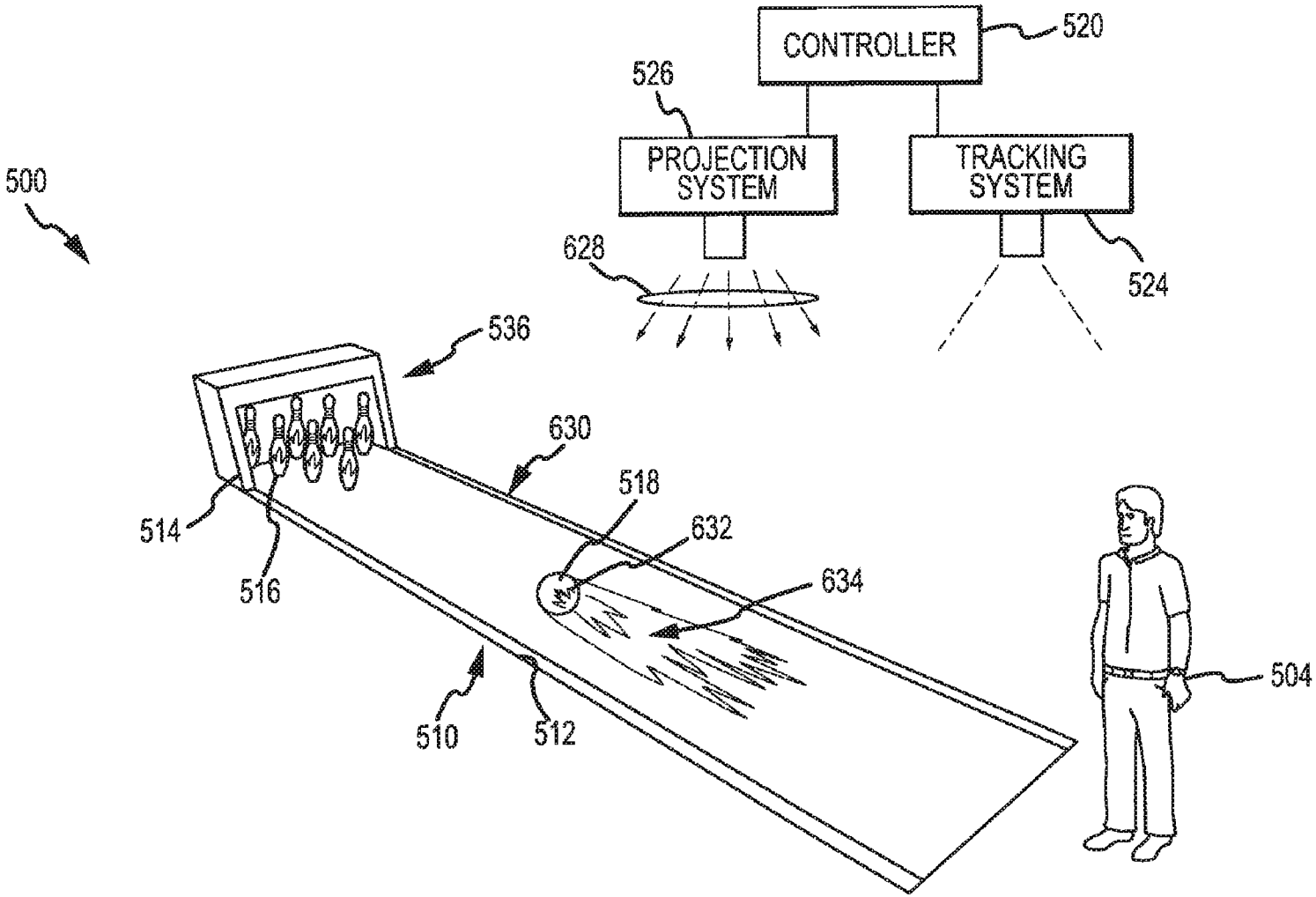

In some embodiments, the user/player or a facility operator may be able to select a different game template so as to change the theme of the overlay image used to enhance the game surfaces. In FIG. 6, the system 500 is being operated with a different template used by the video generator of controller 520 to provide a differently themed augmentation content or projected images 628. In this case, the theme is a fire-based theme and the content 528 generated by the controller 520 includes a relatively dark, solid colored base or background image 630 that is mapped to the alley surface 512 and the pin structure 514 is overlain with an image 636 that appears like a fireplace or fire pit with the pins 516 appearing as flames or flaming logs or the like. The ball 518 is tracked and an image 632 of a fireball or molten rock is projected onto the detected/tracked position of the ball 518 on the alley/game surface 512. A trail of flames or sparks is provided by an animated image 636 displayed in or based on the path/track followed by the ball 518 on the game surface 512 (and stored in memory of controller 520). Special effects typically would also be theme-based and, in this case, may include an explosion when the ball 518 strikes the pins 516 or the ball's flames being extinguished in image 632 if the pins 516 are missed or if the player gets a gutter ball or a burned track shown on the playing surface 512 of the ball's path down the alley.

Figure 7:
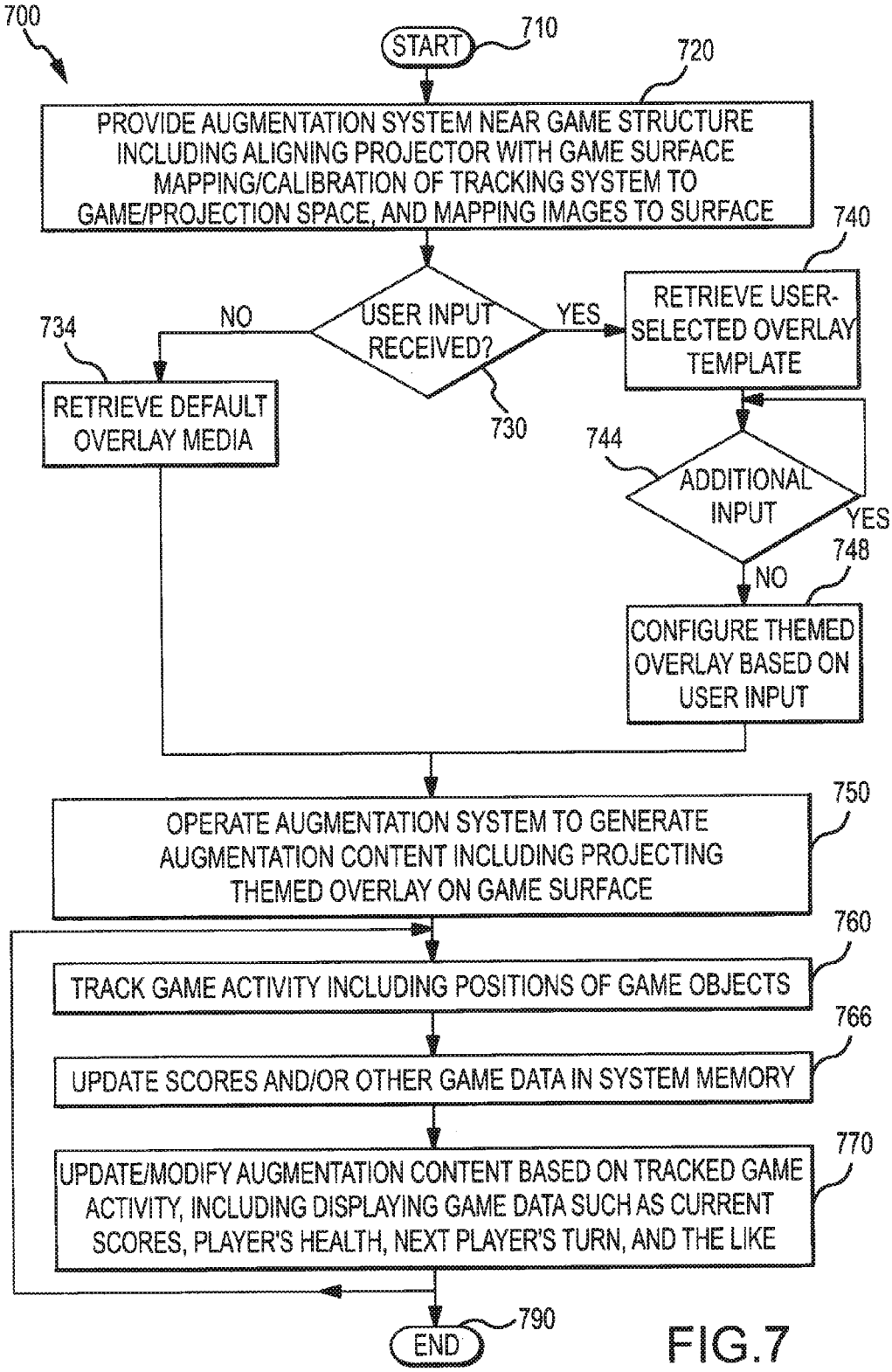
FIG. 7 is a flow diagram or chart showing a dynamic augmentation method that may be implemented by the systems shown in FIGS. 1-6 to dynamically render or generate an augmentation video or projected image stream based on tracked changes in position of game objects (such as balls, cues, paddles, and the like) relative to a game surface and/or based on sensed user interactions/actions.

FIG. 7 illustrates a dynamic augmentation method 700 that may be implemented by the systems shown in FIGS. 1-6 such as by operation of the controllers, including running of software/firmware modules by one or more processors. The method 700 starts at 710 such as by selecting a tracking mechanism for use in determining locations and monitoring movement of game objects relative to a game surface and by providing software modules in a controller or computer system that is useful to provide video generation in a dynamic/real time manner based on processed tracking data. At step 720, the method 700 continues with providing an augmentation system near a game structure such that one or more projectors are aligned with a game surface of the structure. Step 720 may also include mapping augmentation image projected from the projector with the game surface, which may include changing a distance between the projector output and the game surface, focusing of the projector, and/or modifying a generated overlay to suit the size and shape of the game surface.

At step 730, the augmentation system is operated and it is determined whether at the start (or at some point within a game play) user input is received. If not, a default overlay file or overlay media is retrieved from memory (or otherwise accessed by a game controller such as via a digital communications network). If user input is received at 730, the method 700 continues at 740 with a controller retrieving a user-selected overlay template from memory (or otherwise as discussed above). For example, a GUI may be provided to the user via a user input device that includes a pull down list of available game templates for use with a particular game surface, and the user may select one of these templates. Then at 744, the user may be prompted to accept default parameters for the template or to enter additional game/template parameters such as their name, colors, patterns, a game mode to be used, and so on. At 748, the method 700 continues with the controller configuring the themed overlay based on the user input.

At 750, the augmentation system such as via use of one or more video generator modules operates to generate or render augmentation content (or an image stream including static, video/animated, or other image data) and a projector may be used at step 750 to project the themed overlay onto the game surface(s). At 760, the method 700 continues with operating a tracking mechanism to track game activity and/or user interaction with the game surface/game objects (e.g., tracking in real time the position of game objects such as player implements including sticks, rackets, paddles, and the like and game pieces such as balls, pucks, pins, darts, and the like relative to the game surface and the other objects). At 770, the method continues with the controller determining at 766 scores for the game based on step 760 and other game data based on the tracked interactivity and/or movements of game objects, and this step 766 may be very game specific and may vary with game mode (e.g., are added virtual scoring components added to the displayed augmentation content and so on).

At 770, the method 700 includes updating/modifying the augmentation content 770 in memory and as projected by the projector based on the tracked game activity. Step 770 may include providing game data in the projected augmentation content such as the new score, whose turn it is, a health status of each player in the game, and the like. The updated content may also include moving game object images to be projected on new positions of tracked ones of the game objects. The method 700 may continue at 760 or may be terminated or end at 790 with or without storing the current game data in system memory.

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention. For example, it may be useful to modify the game surface and/or the surface of the game objects to achieve a desired projection or enhancement result in response to the projected images/media. This may involve selecting the colors and make up of covering layers/materials for the game surfaces, game object coatings, and other materials applied to the 3D projection surfaces provided by the game structure and objects to achieve a desired result such as to achieve a particular gain (e.g., achieve a gain of 1 to 1.5 or the like), and the gain may be varied on the projection surface to provide desired results.

Further, some of the figures illustrated various hardware, software, and/or firmware components such as those found in the internal systems within the augmentation devices as separate pieces or modules. It will be understood that these modules or components may be combined in a variety of ways such as an augmentation software package with the separately shown pieces being features or feature sets of the one or more packages.

Some augmentation systems may utilize automatic projector/camera alignment techniques. Also, the augmentation systems may utilize more than one projector (e.g., be multi-projector systems to provide augmentation or projected images/media) and such systems may utilize hardware/software devices and/or controllers to provide synchronization of the multiple projectors to achieve a synchronized or desired projected image/media on a projection or game surface. Further, materials may be selected specifically to achieve a desired gain, and it may also be useful to configure the game structure and its projection surfaces to provide superimposed dynamic range (SDR) aspect.

We claim:

1. A system for visually enhancing a game that includes a game structure and physical game objects that may be moved by a player relative to a game surface on the game structure, comprising:

a projector projecting augmentation images onto the game surface;

a tracking mechanism generating tracking data defining positions of the game objects relative to the game surface; and a controller processing the tracking data to determine first and second ones of the positions of the game objects and modifying the augmentation images in response to the positions of the game objects, wherein the controller further operates to generate a first augmentation content based on the first positions, to first operate the projector to project the first augmentation content on the game surface, to generate a second augmentation content based on the second positions, and to second operate the projector to project the second augmentation content on the game surface, wherein the tracking mechanism tracks movement of at least one of the game objects from a corresponding one of the first positions to a corresponding one of the second positions, wherein the controller further operates to generate third augmentation content providing animation for the one of the game objects based on the tracked movement, and wherein the augmentation images comprise a composite digital video stream including a base image mapped to the game surface and at least one game object image mapped to one of the game objects and a corresponding one of the positions, whereby the one game object image is projected onto the one of the game objects.

2. The system of claim 1, wherein the one of the game objects is moving relative to the game surface and wherein the augmentation images are modified to move the one game object image with the one of the game objects.

3. The system of claim 2, wherein the augmentation images further comprise a second game object image comprising a trail image, wherein the controller determines a path followed by the one of the game objects relative to the game surface, and wherein the trail image is provided in the augmentation image to be mapped to a position of the path on the game surface.

4. The system of claim 1, wherein the augmentation images comprise a training component corresponding to the determined positions of the game objects.

5. The system of claim 4, wherein the training component includes graphical components defining a recommended next move determined by the controller based on the determined positions of the game objects.

6. The system of claim 5, wherein the training component includes images defining a path for one of the game objects to follow during the recommended next move.

7. The system of claim 1, wherein the augmentation images comprise a predictive outcome component including animated images and/or text showing a resulting movement of at least one of the game objects based on a suggested interaction with the game surface by a player of the game.

8. The system of claim 1, wherein the controller further determines game data based on the determined positions of the game objects and wherein the modifying of the augmentation content comprises providing the determined game data for projection on or proximate to the game surface.

9. The system of claim 1, further comprising memory storing a set of game templates defining themed overlays for the game surface, wherein the controller is operable to receive user input selecting one of the game templates and wherein the augmentation images are generated based on the selected one of the game templates and based on the determined positions of the game objects.

10. The system of claim 1, wherein the augmentation images include a score for the game, the game score being updated based on the tracked movement.

11. The system of claim 10, wherein the controller determines a position of one of the game objects on the game surface and wherein the augmentation images include an object enhancing image mapped to the position of the one of the game objects.

12. The system of claim 10, wherein the augmentation images comprise a teaching portion including images guiding a player to perform actions to produce the tracked movement of the game objects.

13. The system of claim 1, wherein the controller further records the tracked movement and operates to replay the recorded tracked movement on the game surface by operation of the projector.

14. A game augmentation system for dynamically projecting images on a game surface, comprising:

a tracking mechanism determining first and second positions of a plurality of physical game objects relative to the game surface at first and second times, wherein at least some of the second positions differ from the first positions;

a projector projecting onto the game surface; and a control system generating a first augmentation content based on the first positions, first operating the projector to project the first augmentation content on the game surface, generating a second augmentation content based on the second positions, and second operating the projector to project the second augmentation content on the game surface, wherein the tracking mechanism tracks movement of at least one of the game objects from a corresponding one of the first positions to a corresponding one of the second positions, wherein the control system further operates to generate third augmentation content providing animation for the one of the game objects based on the tracked movement, and wherein the first augmentation content and the second augmentation content each comprises a composite digital video stream including a base image mapped to the game surface and at least one game object image mapped to one of the game objects and a corresponding one of the positions, whereby the one game object image is projected onto the one of the game objects.

15. The system of claim 14, further comprising a video generator running on the controller and acting to generate the first and second augmentation content based on the first and second positions and based on image data of a game template accessed by the control system.

16. The system of claim 15, wherein the game template is selected based on user input from a set of overlay image templates stored in memory.

17. The system of claim 14, wherein the first augmentation content and the second augmentation content include a virtual scoring image mapped to a position on the game surface, wherein the tracking of the movement by the tracking mechanism includes determining whether one of the game objects crosses the position of the virtual scoring image, and wherein the second augmentation content is updated based on the determining of whether the one of the game objects crossed the position.

18. The system of claim 14, wherein the control system further records the tracked movement and operates to replay the recorded tracked movement on the game surface by operation of the projector.

* * * * *